US009830902B1

(12) United States Patent
Terashima et al.

(10) Patent No.: US 9,830,902 B1
(45) Date of Patent: Nov. 28, 2017

(54) ACTIVE SOUND CONTROL APPARATUS

(71) Applicant: HONDA MOTOR CO., LTD., Tokyo (JP)

(72) Inventors: Osamu Terashima, Wako (JP); Toshio Inoue, Wako (JP); Yasunori Kobayashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/589,316

(22) Filed: May 8, 2017

(30) Foreign Application Priority Data

May 11, 2016 (JP) ..... 2016-095213

(51) Int. Cl.
*G10K 11/178* (2006.01)
*H04R 3/00* (2006.01)

(52) U.S. Cl.
CPC ..... *G10K 11/1786* (2013.01); *G10K 11/1788* (2013.01); *H04R 3/002* (2013.01); *G10K 2210/129* (2013.01); *G10K 2210/1282* (2013.01)

(58) Field of Classification Search
CPC ..... G10K 15/02; G10K 2210/1282; G10K 15/04; G10K 2210/3219; G10K 11/178; G10K 11/18; G10K 2210/3213
See application file for complete search history.

(56) References Cited

U.S. PATENT DOCUMENTS

2008/0310642 A1* 12/2008 Sakamoto ..... G10K 15/02 381/61
2009/0028353 A1* 1/2009 Kobayashi ..... A63G 31/16 381/61
2011/0206213 A1* 8/2011 Sakamoto ..... G10K 11/1782 381/71.4
2012/0101611 A1* 4/2012 Inoue ..... G10K 15/02 700/94
2012/0106748 A1* 5/2012 Peachey ..... B60Q 5/00 381/61
2015/0353007 A1* 12/2015 Inoue ..... B60Q 5/00 381/61
2017/0248048 A1* 8/2017 Dziurda ..... F01N 1/165

FOREIGN PATENT DOCUMENTS

JP 2015-229403 A 12/2015

* cited by examiner

*Primary Examiner* — Mohammad Islam
(74) *Attorney, Agent, or Firm* — Rankin, Hill & Clark LLP

(57) ABSTRACT

An ASC apparatus, which actively generates a sound effect inside a cabin of a vehicle provided with an internal combustion engine and an electric motor as driving sources, includes: a reference signal generating unit which generates a harmonic reference signal based on a vehicle-speed-corresponding frequency, being a frequency based on a vehicle speed, by referring to waveform data; a driver seat speaker which outputs a sound including the sound effect; and a signal processing unit which generates a control signal that forms the sound effect by multiplying the reference signal by a sound effect gain related to the reference signal, and outputs the control signal to the driver seat speaker. The signal processing unit sets the sound effect gain based on a state of charge of a storage battery.

14 Claims, 4 Drawing Sheets

ACTIVE SOUND CONTROL APPARATUS

BACKGROUND OF THE INVENTION

1. Field of the Invention

The present invention relates to an active sound control apparatus to be used in a vehicle provided with an internal combustion engine and an electric motor as driving sources, which is configured to generate a sound effect in a vehicle interior.

2. Description of the Related Art

The applicant of this application has proposed a sound effect generating apparatus (Japanese Patent Application Publication No. 2015-229403: Patent Document 1) to be used in a vehicle provided with an internal combustion engine and an electric motor as driving sources, which is configured to generate a sound effect in a vehicle interior.

The sound effect generating apparatus according to Patent Document 1 (see claim 3) includes: a waveform data table that stores a waveform data corresponding to one waveform period; a vehicle speed detecting unit that detects a vehicle speed; a frequency setting unit that sets a vehicle-speed-corresponding frequency, which is a frequency defined on the basis of the vehicle speed detected by the vehicle speed detecting unit; a reference signal generating unit that generates a reference signal having a harmonic in accordance with the vehicle-speed-corresponding frequency by referring to the waveform data; a control signal generating unit that generates a control signal used for generation of a sound effect on the basis of the reference signal; an output unit that outputs the control signal converted into the sound effect; a rotational frequency detecting unit that detects a rotational frequency of an engine; an amount-of-change-in-rotational frequency calculating unit that calculates an amount of change in the rotational frequency, which is a time differential value of the rotational frequency; and a driving source load detecting unit that detects a load of a driving source of a vehicle.

The control signal generating unit adjusts an amplitude of the control signal by varying an amplitude of the reference signal in accordance with the amount of change in frequency and a load of the driving source. Moreover, the driving source load detecting unit detects a load of the engine. The reference signal generating unit generates the reference signal on the basis of the rotational frequency of the engine when only the engine is in a driving state, and meanwhile, generates the reference signal on the basis of an arbitration frequency resulting from arbitration or selection of the vehicle-speed-corresponding frequency and the rotational frequency of the engine when both the engine and an electric motor are in the driving state.

The sound effect generating apparatus according to Patent Document 1 can appropriately output a sound effect even in the case of a change in operating state of any of the driving sources in a hybrid vehicle.

However, the sound effect generating apparatus according to Patent Document 1 has room for improvement in terms of potential occurrence of a case in which the apparatus may provide a sound effect inconsistent with conditions of the vehicle or an intention of a passenger.

A description will be given below of such a potential case. Specifically, in a hybrid vehicle provided with an internal combustion engine and an electric motor as driving sources, the type of the driving source used and a level of output from the driving source generally vary depending on a battery residual quantity of a storage battery.

To be more precise, when the driving sources include the internal combustion engine and the electric motor, for example, the output of the internal combustion engine is controlled small if the battery residual quantity of the storage battery is relatively large.

Meanwhile, if the battery residual quantity of the storage battery is relatively small, then power for charging the storage battery and a drive force for traveling are solely covered by the internal combustion engine (without using the electric motor). In this case, the engine maintains a relatively high rotational frequency, whereas the amount of change in vehicle speed tends to be small. At this time, if the reference signal is generated on the basis of the relatively high rotational frequency of the engine and the control signal to be used for generation of a sound effect is generated on the basis of the reference signal thus generated, then the apparatus consequently provides a sound effect having a sound pressure level higher than a sound pressure level suitable for the actual degree of acceleration of the vehicle (a sound effect inconsistent with conditions of the vehicle or an intension of a passenger).

SUMMARY OF THE INVENTION

The present invention has been made in view of the above-mentioned circumstances. An object of the present invention is to provide an active sound control apparatus to be used in a vehicle provided with an internal combustion engine and an electric motor as driving sources, which is capable of arranging a sound effect that matches a condition of the vehicle or an intension of a passenger.

To attain the object, a first aspect of the invention provides an active sound control apparatus which actively generates a sound effect inside a cabin of a vehicle provided with an internal combustion engine and an electric motor as driving sources, including: a waveform data table which stores waveform data used to generate the sound effect; a vehicle-speed-corresponding frequency converting unit which converts a vehicle speed of the vehicle into a vehicle-speed-corresponding frequency that is a frequency based on the vehicle speed; a reference signal generating unit which generates a harmonic reference signal based on the vehicle-speed-corresponding frequency by referring to the waveform data; a sound output unit which outputs a sound including the sound effect; a signal processing unit which generates a control signal that forms the sound effect by multiplying the reference signal by an amplitude adjustment gain related to the reference signal, and outputs the control signal to the sound output unit; and a state-of-charge acquisition unit which acquires a state of charge inclusive of a residual capacity of a storage battery that supplies electric power to the electric motor, in which the most important feature of the signal processing unit is to set the amplitude adjustment gain based on the state of charge of the storage battery.

In the first aspect of the invention, the reference signal generating unit generates the harmonic reference signal based on the vehicle-speed-corresponding frequency by referring to the waveform data. The signal processing unit generates the control signal that forms the sound effect by multiplying the reference signal by the amplitude adjustment gain related to the reference signal, and outputs the control signal to the sound output unit. Here, the signal processing unit is configured to set the amplitude adjustment gain based on the state of charge of the storage battery.

According to the first aspect of the invention, the signal processing unit sets the amplitude adjustment gain related to the reference signal based on the state of charge of the storage battery. Thus, the active signal control apparatus can arrange the sound effect in the vehicle provided with the internal combustion engine and the electric motor as the driving sources, which matches a condition of the vehicle or an intention of a passenger.

Meanwhile, a second aspect of the invention provides the active signal control apparatus according to the first aspect in which, in the case where the residual capacity of the storage battery falls below a predetermined first residual capacity threshold, the signal processing unit sets the amplitude adjustment gain smaller than that in the case where the residual capacity of the storage battery is equal to or above the first residual capacity threshold. As for the first residual capacity threshold, a value of the residual capacity, at which charge control of the storage battery is to be started, or the like may be set as appropriate, for example.

According to the second aspect of the invention, in the case where the residual capacity of the storage battery falls below the predetermined first residual capacity threshold, the signal processing unit sets the amplitude adjustment gain smaller than that in the case where the residual capacity of the storage battery is equal to or above the first residual capacity threshold. Thus, the active signal control apparatus can appropriately arrange the sound effect that matches the condition of the vehicle or the intention of the passenger.

Meanwhile, a third aspect of the invention provides the active signal control apparatus according to the first aspect in which, in the case where the residual capacity of the storage battery falls below the predetermined first residual capacity threshold, the signal processing unit sets the amplitude adjustment gain substantially equal to zero. Here, setting the amplitude adjustment gain substantially equal to zero means practically withdrawing the provision of the sound effect by setting an amplitude of a signal component related to the sound effect equal to zero.

According to the third aspect of the invention, in the case where the residual capacity of the storage battery falls below the first residual capacity threshold, the signal processing unit sets the amplitude adjustment gain substantially equal to zero. Thus, the active signal control apparatus can appropriately arrange the sound effect that matches the condition of the vehicle or the intention of the passenger as a result of withdrawing the provision of the sound effect in a situation where the sound effect is unnecessary.

Meanwhile, a fourth aspect of the invention provides the active signal control apparatus according to the first aspect in which, in the case where the residual capacity of the storage battery is equal to or above a predetermined second residual capacity threshold, the signal processing unit sets the amplitude adjustment gain larger than that in the case where the residual capacity of the storage battery falls below the second residual capacity threshold.

According to the fourth aspect of the invention, in the case where the residual capacity of the storage battery is equal to or above the second residual capacity threshold, the signal processing unit sets the amplitude adjustment gain larger than that in the case where the residual capacity of the storage battery falls below the second residual capacity threshold. Thus, the active signal control apparatus can appropriately arrange the sound effect that matches the condition of the vehicle or the intention of the passenger as a result of raising a sound pressure level of the sound effect in the case where the drive control of the electric motor is performed on a preferential basis (where it is appropriate to provide the sound effect).

Meanwhile, a fifth aspect of the invention provides the active signal control apparatus according to the second aspect in which, in the case where driving of the electric motor is practically stopped, the signal processing unit sets the amplitude adjustment gain smaller than that in the case where the residual capacity of the storage battery is equal to or above the first residual capacity threshold. Here, the case where the driving of the electric motor is practically stopped means a state where the driving of the vehicle and charging of the storage battery are covered by a drive force of the internal combustion engine.

According to fifth aspect of the invention, in the case where the driving of the electric motor is practically stopped, the signal processing unit sets the amplitude adjustment gain smaller than that in the case where the residual capacity of the storage battery is equal to or above the first residual capacity threshold. Thus, the active signal control apparatus can appropriately arrange the sound effect that matches the condition of the vehicle or the intention of the passenger as with the second aspect of the invention.

Meanwhile, a sixth aspect of the invention provides the active signal control apparatus according to the third aspect in which, in the case where the driving of the electric motor is practically stopped, the signal processing unit sets the amplitude adjustment gain substantially equal to zero.

According to the sixth aspect of the invention, in the case where the driving of the electric motor is practically stopped, the signal processing unit sets the amplitude adjustment gain substantially equal to zero. Thus, the active signal control apparatus can appropriately arrange the sound effect that matches the condition of the vehicle or the intention of the passenger as a result of withdrawing the provision of the sound effect in a situation where the sound effect is unnecessary as with the third aspect of the invention.

Meanwhile, a seventh aspect of the invention provides the active signal control apparatus according to the fourth aspect in which, in the case where the electric motor is driven, the signal processing unit sets the amplitude adjustment gain larger than that in the case where the residual capacity of the storage battery falls below the second residual capacity threshold.

According to the seventh aspect of the invention, in the case where the electric motor is driven, the signal processing unit sets the amplitude adjustment gain larger than that in the case where the residual capacity of the storage battery falls below the second residual capacity threshold. Thus, the active signal control apparatus can appropriately arrange the sound effect that matches the condition of the vehicle or the intention of the passenger as a result of raising the sound pressure level of the sound effect in the situation where the drive control of the electric motor is performed on the preferential basis (where it is appropriate to provide the sound effect) as with the fourth aspect of the invention.

In the meantime, an eighth aspect of the invention provides an active sound control apparatus which actively generates a sound effect inside a cabin of a vehicle provided with an internal combustion engine and an electric motor as driving sources, including: a waveform data table which stores waveform data used to generate the sound effect; a vehicle-speed-corresponding frequency converting unit which converts a vehicle speed of the vehicle into a vehicle-speed-corresponding frequency that is a frequency based on the vehicle speed; a reference signal generating unit which generates a harmonic reference signal based on the vehicle-speed-corresponding frequency by referring to the waveform data; a sound output unit which outputs a sound including the sound effect; a signal processing unit which generates a control signal that forms the sound effect by multiplying the reference signal by an amplitude adjustment gain related to the reference signal, and outputs the control signal to the sound output unit; and a supplied electric power acquisition unit which acquires electric power supplied from a storage battery to the electric motor, in which the most important feature of the signal processing unit is to set the amplitude adjustment gain based on the electric power supplied to the electric motor.

In the eighth aspect of the invention, the reference signal generating unit generates the harmonic reference signal based on the vehicle-speed-corresponding frequency by referring to the waveform data. The signal processing unit generates the control signal that forms the sound effect by multiplying the reference signal by the amplitude adjustment gain related to the reference signal, and outputs the control signal to the sound output unit. Here, the signal processing unit is configured to set the amplitude adjustment gain based on the electric power supplied to the electric motor.

According to the eighth aspect of the invention, the signal processing unit sets the amplitude adjustment gain related to the reference signal based on the electric power supplied to the electric motor. Thus, the active signal control apparatus can arrange the sound effect in the vehicle provided with the internal combustion engine and the electric motor as the driving sources, which matches the condition of the vehicle or the intention of the passenger.

Meanwhile, a ninth aspect of the invention provides the active signal control apparatus according to the eighth aspect in which, in the case where a supplied electric power amount to the electric motor falls below a predetermined first electric power amount threshold, the signal processing unit sets the amplitude adjustment gain smaller than that in the case where the supplied electric power amount is equal to or above the first electric power amount threshold.

According to the ninth aspect of the invention, in the case where the supplied electric power amount to the electric motor falls below the first electric power amount threshold, the signal processing unit sets the amplitude adjustment gain smaller than that in the case where the supplied electric power amount to the electric motor is equal to or above the first electric power amount threshold. Thus, the active signal control apparatus can appropriately arrange the sound effect that matches the condition of the vehicle or the intention of the passenger.

Meanwhile, a tenth aspect of the invention provides the active signal control apparatus according to the eighth aspect in which, in the case where the supplied electric power amount to the electric motor falls below the predetermined first electric power amount threshold, the signal processing unit sets the amplitude adjustment gain substantially equal to zero. Here, setting the amplitude adjustment gain substantially equal to zero means practically withdrawing the provision of the sound effect by setting the amplitude of the signal component related to the sound effect equal to zero.

According to the tenth aspect of the invention, in the case where the supplied electric power amount to the electric motor falls below the first electric power amount threshold, the signal processing unit sets the amplitude adjustment gain substantially equal to zero. Thus, the active signal control apparatus can appropriately arrange the sound effect that matches the condition of the vehicle or the intention of the passenger as a result of withdrawing the provision of the sound effect in a situation where the sound effect is unnecessary.

Meanwhile, an eleventh aspect of the invention provides the active signal control apparatus according to the eighth aspect in which, in the case where the supplied electric power amount to the electric motor is equal to or above a predetermined second electric power amount threshold, the signal processing unit sets the amplitude adjustment gain larger than that in the case where the supplied electric power amount falls below the second electric power amount threshold. Here, as for the second electric power amount threshold, a value of the supplied electric power amount to the electric motor, in the case where the drive control of the electric motor is performed on the preferential basis, or the like may be set as appropriate, for example. Here, the case where the supplied electric power amount to the electric motor is equal to or above the second electric power amount threshold is assumed to be a case where the drive control of the electric motor is performed on the preferential basis.

According to the eleventh aspect of the invention, in the case where the supplied electric power amount to the electric motor is equal to or above the second electric power amount threshold, the signal processing unit sets the amplitude adjustment gain larger than that in the case where the supplied electric power amount to the electric motor falls below the second electric power amount threshold. Thus, the active signal control apparatus can appropriately arrange the sound effect that matches the condition of the vehicle or the intention of the passenger as a result of raising the sound pressure level of the sound effect in the case where the drive control of the electric motor is performed on the preferential basis.

Meanwhile, a twelfth aspect of the invention provides the active signal control apparatus according to the ninth aspect in which, in the case where the driving of the electric motor is practically stopped, the signal processing unit sets the amplitude adjustment gain smaller than that in the case where the supplied electric amount is equal to or above the first electric power amount threshold. Here, the case where the driving of the electric motor is practically stopped means the state where the driving of the vehicle and the charging of the storage battery are covered by the drive force of the internal combustion engine.

According to the twelfth aspect of the invention, in the case where the driving of the electric motor is practically stopped, the signal processing unit sets the amplitude adjustment gain smaller than that in the case where the supplied electric amount is equal to or above the first electric power amount threshold. Thus, the active signal control apparatus can appropriately arrange the sound effect that matches the condition of the vehicle or the intention of the passenger as with the ninth aspect of the invention.

Meanwhile, a thirteenth aspect of the invention provides the active signal control apparatus according to the tenth aspect in which, in the case where the driving of the electric motor is practically stopped, the signal processing unit sets the amplitude adjustment gain substantially equal to zero.

According to the thirteenth aspect of the invention, in the case where the driving of the electric motor is practically stopped, the signal processing unit sets the amplitude adjustment gain substantially equal to zero. Thus, the active signal control apparatus can appropriately arrange the sound effect that matches the condition of the vehicle or the intention of the passenger as a result of withdrawing the provision of the sound effect in a situation where the sound effect is unnecessary as with the tenth aspect of the invention.

Meanwhile, a fourteenth aspect of the invention provides the active signal control apparatus according to the eleventh aspect in which, in the case where the electric motor is driven, the signal processing unit sets the amplitude adjustment gain larger than that in the case where the supplied electric amount falls below the second electric power amount threshold.

According to the fourteenth aspect of the invention, in the case where the electric motor is driven, the signal processing unit sets the amplitude adjustment gain larger than that in the case where the supplied electric amount falls below the second electric power amount threshold. Thus, the active signal control apparatus can appropriately arrange the sound effect that matches the condition of the vehicle or the intention of the passenger as a result of raising the sound pressure level of the sound effect in the case where the drive control of the electric motor is performed on the preferential basis as with the eleventh aspect of the invention.

In a vehicle provided with an internal combustion engine and an electric motor as driving sources, an active sound control apparatus according to the present invention can arrange a sound effect that matches a condition of the vehicle or an intension of a passenger.

DETAILED DESCRIPTION OF THE EMBODIMENTS

Figure 1:
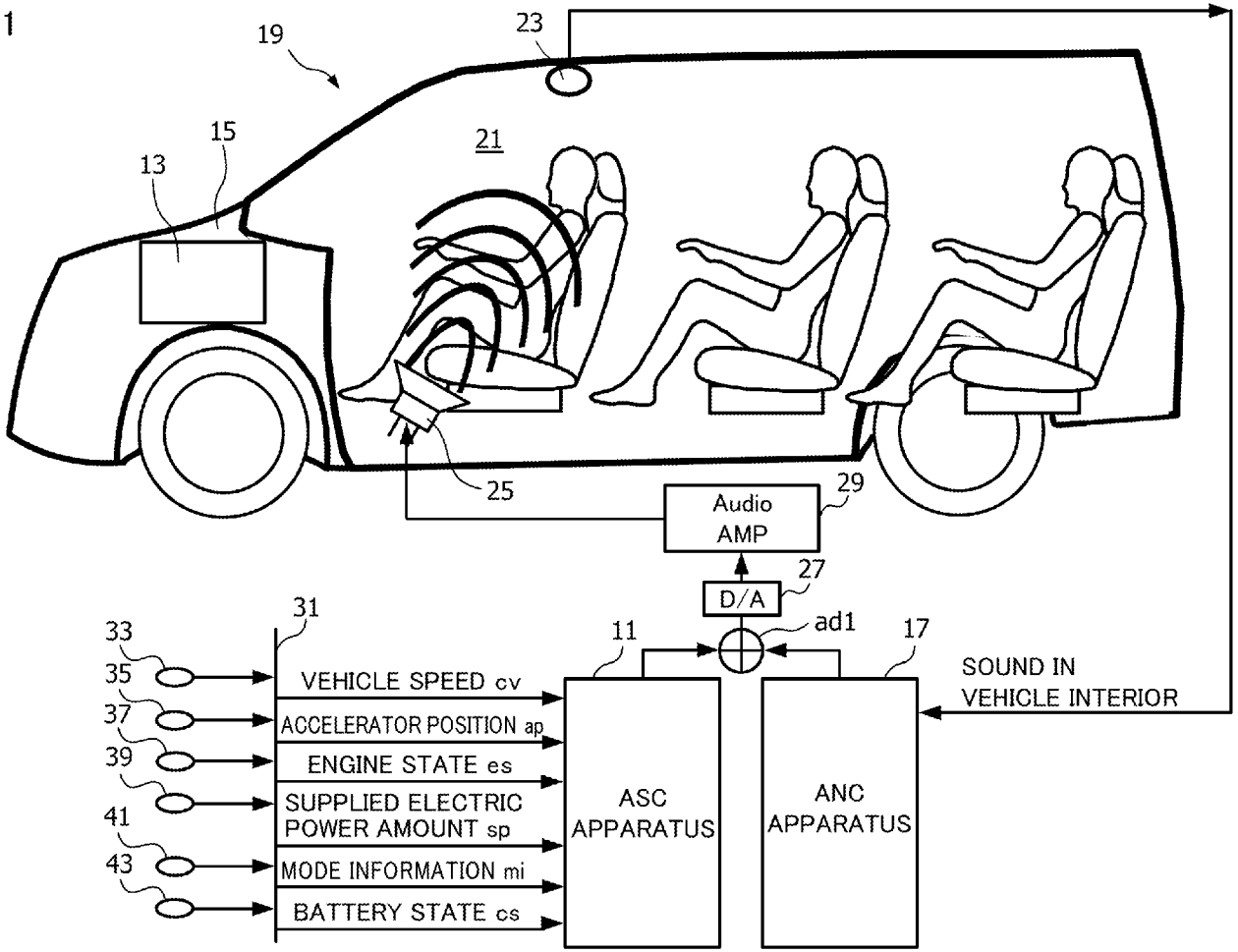
FIG. 1 is a schematic configuration diagram of a vehicle mounting an active sound control apparatus (hereinafter abbreviated as an "AEC apparatus" as appropriate) according to an embodiment of the present invention.

Active sound control apparatuses according to embodiments of the present invention will be described below in detail with reference to the accompanying drawings.

Note that in the drawings shown below, components having the same functions or components having mutually related functions will be denoted by the same reference signs in principle. In the meantime, the size and shape of each of the components may be schematically illustrated by way of deformation or exaggeration as appropriate for the convenience of explanation.

(Outline of Active Sound Control Apparatus (ASC Apparatus) 11 According to Embodiment of Present Invention)

Figure 2:
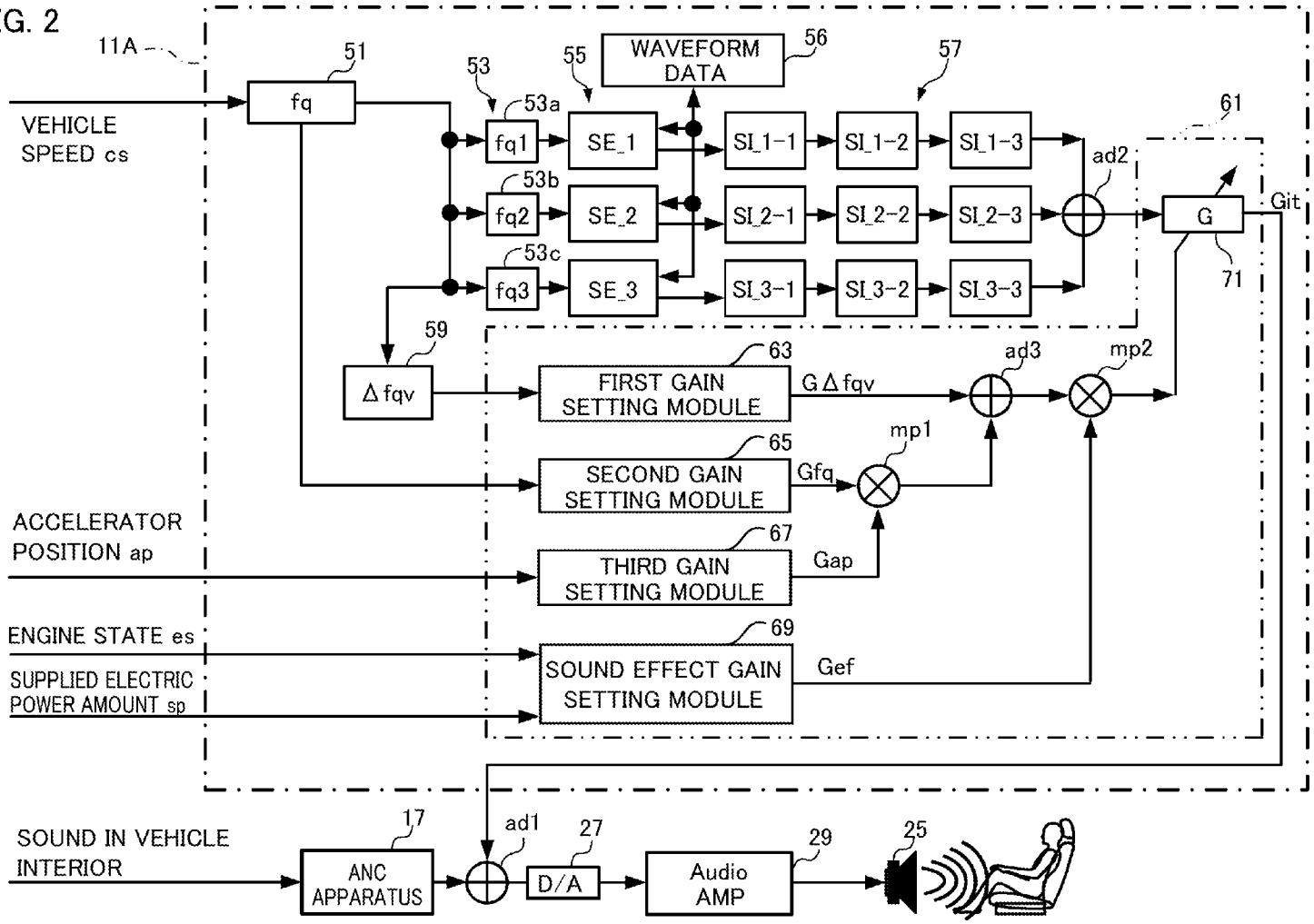
FIG. 2 is a block configuration diagram showing an internal configuration of an ASC apparatus according to a first embodiment.

An outline of an active sound control apparatus (ASC apparatus) 11 according to an embodiment of the present invention will be described with reference to FIGS. 1 and 2 by citing an example of mounting the ASC apparatus 11 on a hybrid vehicle (hereinafter abbreviated as a "vehicle" as appropriate) 15 equipped with an internal combustion engine (hereinafter abbreviated as an "engine" as appropriate) 13 and an electric motor (not shown) as driving sources. FIG. 1 is a schematic configuration diagram of the vehicle 15 mounting the ASC apparatus 11. FIG. 2 is a block configuration diagram showing an internal configuration of an ASC apparatus 11A according to a first embodiment.

It is to be noted that reference sign "11" will be used in this specification when ASC apparatuses 11A, 11B, and 11C according to first to third embodiments are collectively referred to as the ASC apparatus according to the embodiment of the present invention.

The hybrid vehicle 15 has functions to perform drive control of at least one of the internal combustion engine 13 and the electric motor and to perform charge control of a storage battery based on a state of charge of the storage battery that supplies electric power to the electric motor.

The ASC apparatus 11 according to the embodiment of the present invention constitutes a vehicle active sound effect generation system 19 together with an active noise control apparatus (ANC apparatus) 17 that actively controls a sound pressure related to noise that enters the inside of a cabin of the vehicle 15 (hereinafter referred to as a "vehicle interior" as appropriate).

The vehicle active sound effect generation system 19 has functions to arrange a driving environment that matches maneuvering feeling of a driver, and to generate a sound effect for actively suppressing the sound pressure related to the noise that enters the vehicle interior.

As shown in FIG. 1, the vehicle active sound effect generation system 19 equipped with the ASC apparatus 11 and the ANC apparatus 17 includes: a driver seat microphone 23 provided in a driver seat space 21 in the vehicle interior and configured to collect sounds generated in the driver seat space 21; a driver seat speaker 25 provided in the driver seat space 21 and configured to output sounds including sound effects; an adder ad1 configured to add sound effect (digital) signals (which have sound pressure frequency characteristics related to sound effects at an arbitrary time point) from the ASC apparatus 11 and the ANC apparatus 17; a D/A converter 27 configured to convert a sound effect (digital) signal from the adder ad1 into an analog signal; and an audio amplifier 29 configured to amplify a sound (analog) signal containing the sound effect converted by the D/A converter 27 and to output the amplified signal to the driver seat speaker 25. The driver seat speaker 25 corresponds to a "sound output unit" of the present invention.

As shown in FIG. 1, various sensors including a vehicle speed sensor 33, an accelerator position sensor 35, an engine state sensor 37, an amount-of-electric-power sensor 39, a mode information sensor 41, and a battery state sensor 43 are connected to the ASC apparatus 11 through a communication medium 31 such as a control area network (CAN).

The vehicle speed sensor 33 has a function to detect a traveling speed (a vehicle speed) of the vehicle 15. A time-series signal (a vehicle speed signal) cv of the vehicle speed detected by the vehicle speed sensor 33 is sent to the ASC apparatus 11 through the communication medium 31.

The accelerator position sensor 35 has a function to detect an accelerator position in accordance with an amount of pressing operation of an accelerator pedal (not shown) by the driver. A time-series signal (an accelerator position signal) ap of the accelerator position detected by the accelerator position sensor 35 is sent to the ASC apparatus 11 through the communication medium 31.

The engine state sensor 37 has a function to acquire an operating state of the engine 13. An engine rotational speed (a rotational frequency) may be cited as an example of the operating state of the engine 13. A time-series signal (an engine state signal) es of the engine state (an engine rotational frequency) acquired by the engine state sensor 37 is sent to the ASC apparatus 11 through the communication medium 31.

The amount-of-electric-power sensor 39 has a function to acquire an amount of electric power supplied from a storage battery (not shown) to the electric motor. A time-series signal (a supplied electric power amount signal) sp of the amount of the supplied electric power acquired by the amount-of-electric-power sensor 39 is sent to the ASC apparatus 11 through the communication medium 31. The amount-of-electric-power sensor 39 corresponds to a "supplied electric power acquisition unit" of the present invention.

The mode information sensor 41 has a function to acquire information on various modes occurring in the vehicle 15. Examples of the mode information (modes to be set by a selecting operation by a passenger on the vehicle 15) include charge mode information, traveling mode information, drive force transmission mode information, and the like. The charge mode information is information concerning whether or not the storage battery is set to a charge mode (to be charged on a preferential basis). The traveling mode information is information concerning whether or not a traveling mode of the vehicle 15 is set to a sport traveling mode (in which the engine rotational frequency is kept high). The drive force transmission mode information is information concerning whether or not a drive force transmission mode of the vehicle 15 is set to an engine direct coupling mode (in which the drive force is increased on a preferential basis). Such mode information mi acquired by the mode information sensor 41 is sent to the ASC apparatus 11 through the communication medium 31.

The battery state sensor 43 has a function to acquire battery state information concerning the storage battery. Examples of the battery state information include: a current value flowing on the storage battery; and a voltage value between terminals, an amount of outputted electric power, a temperature value, a state of charge (SOC), a state of health (SOH), a residual capacity, and the like of the storage battery. Such battery state information cs acquired by the battery state sensor 43 is sent to the ASC apparatus 11 through the communication medium 31.

The ASC apparatus 11 has a function to generate a sound effect so as to match the maneuvering feeling of the driver based on the vehicle speed signal cv, the accelerator position signal ap, the engine state signal es, the supplied electric power amount signal sp, the mode information mi, the battery state information cs, and the like.

(Internal Configuration of ASC Apparatus 11A According to First Embodiment)

Next, an internal configuration of an ASC apparatus 11A according to a first embodiment will be described with reference to FIG. 2. FIG. 2 is a block configuration diagram showing the internal configuration of the ASC apparatus 11A according to the first embodiment.

As shown in FIG. 2, the ASC apparatus 11A according to the first embodiment includes a vehicle-speed-corresponding frequency converting unit 51, a multiplying unit 53, a reference signal generating unit 55, a waveform data table 56, a control signal generating unit 57, an adder ad2, an amount-of-change-in-frequency detecting unit 59, and a signal processing unit 61. A variety of signal processing in the form of digital signals takes place in the ASC apparatus 11.

Specifically, the ASC apparatus 11A is formed from a microcomputer including, for example, a central processing unit (CPU), a read only memory (ROM), a random access memory (RAM), and the like.

The vehicle-speed-corresponding frequency converting unit 51 has functions to convert a change in vehicle speed into a change in frequency, and to output a vehicle-speed-corresponding frequency fq in the form of a digital signal.

The multiplying unit 53 includes, for example, a second-order multiplying module 53*a* that outputs a doubled frequency (a second harmonic vehicle-speed-corresponding frequency fq1), a third-order multiplying module 53*b* that outputs a tripled frequency (a third harmonic vehicle-speed-corresponding frequency fq2), and a fourth-order multiplying module 53*c* that outputs a quadrupled frequency (a fourth harmonic vehicle-speed-corresponding frequency fq3), which are based on the vehicle-speed-corresponding frequency fq of the basic order converted by the vehicle-speed-corresponding frequency converting unit 51. The multiplying factors used by the multiplying unit 53 are not limited only to integers such as 2, 3, 4, 5, 6, and so on but may also be other actual numbers such as 2.5, 3.3, and so on. In the meantime, the multiplying factors used by the multiplying unit 53 may consist of arbitrary inconsecutive numbers such as 3, 5, 7, and so on.

The reference signal generating unit 55 has a function to generate harmonic reference signals (sinusoidal signals) based respectively on the vehicle-speed-corresponding frequencies fq1, fq2, and fq3 that are sent out of the multiplying unit 53 from moment to moment, by referring to waveform data stored in the waveform data table 56.

To be more precise, the reference signal generating unit 55 includes: a first reference signal generating module SE_1 which generates a second harmonic reference signal based on the second harmonic vehicle-speed-corresponding frequency fq1 outputted from the second-order multiplying module 53*a;* a second reference signal generating module SE_2 which generates a third harmonic reference signal based on the third harmonic vehicle-speed-corresponding frequency fq2 outputted from the third-order multiplying module 53*b;* and a third reference signal generating module SE_3 which generates a fourth harmonic reference signal based on the fourth harmonic vehicle-speed-corresponding frequency fq3 outputted from the fourth-order multiplying module 53*c*.

The first reference signal generating module SE_1, the second reference signal generating module SE_2, and the third reference signal generating module SE_3 have the same function.

Note that the configuration of the reference signal generating unit 55 is the same as the technical matters described in Patent Document 2 (Japanese Patent Application Publication No. 2006-301598), paragraphs 0041-0047, etc. and a detailed description thereof will be omitted.

The control signal generating unit 57 includes: flattening processing modules SI_1-1, SI_2-1, and SI_3-1 which perform processing to generate sound effects having linear feeling with respect to an accelerating operation by use of the reference signals related to the sound effects generated by the reference signal generating unit 55; frequency emphasis processing modules SI_1-2, SI_2-2, and SI_3-2 which perform processing to emphasize sound components that belong to a certain frequency band; and order-based correction processing modules SI_1-3, SI_2-3, and SI_3-3 which perform processing to correct the reference signals based on the orders.

Note that the configuration of the control signal generating unit 57 is the same as the technical matters described in Patent Document 2 (Japanese Patent Application Publication No. 2006-301598), paragraph 0062, etc. and a detailed description thereof will be omitted.

The control signal generating unit 57 constitutes part of a "signal processing unit" of the present invention.

The adder ad2 outputs a control signal which is obtained by adding three signals (which have the sound pressure frequency characteristics related to the sound effects at the arbitrary time point) after the processing by the order-based correction processing modules SI_1-3, SI_2-3, and SI_3-3.

In terms of the vehicle-speed-corresponding frequency fq being the time-series data, the amount-of-change-in-frequency detecting unit 59 finds a difference Δfq (where Δfq=fqt2−fqt1) between a frequency fqt1 at a certain time point t1 and a frequency fqt2 at a time point t2 immediately after the time point t1, and then multiplies the difference Δfq by the frequency fqt2 at the time point t2, thereby calculating and outputting an amount of change in frequency Δfqv (Δfqv=Δfq*fqt2) [Hz/sec] per unit time at the vehicle-speed-corresponding frequency fq, i.e., an acceleration rate of the vehicle 15.

Note that the configuration of the amount-of-change-in-frequency detecting unit 59 is the same as the technical matters described in Patent Document 2 (Japanese Patent Application Publication No. 2006-301598), paragraphs 0082-0086, etc. and a detailed description thereof will be omitted.

As shown in FIG. 2, the signal processing unit 61 includes a first gain setting module 63, a second gain setting module 65, a third gain setting module 67, a sound effect gain setting module 69A, a multiplier mp1, an adder ad3, a multiplier mp2, and a correction filter 71.

The first gain setting module 63 has functions to prepare a map that defines a relation between the amount of change in frequency Δfqv and a gain corresponding thereto (hereinafter referred to as an "amount-of-change-in-frequency gain GΔfqv"), and to set the amount-of-change-in-frequency gain GΔfqv based on the amount of change in frequency Δfqv calculated and outputted by the amount-of-change-in-frequency detecting unit 59.

The second gain setting module 65 has functions to prepare a map that defines a relation between the vehicle-speed-corresponding frequency fq and a gain corresponding thereto (hereinafter referred to as a "vehicle-speed-corresponding frequency gain Gfq"), and to set the vehicle-speed-corresponding frequency gain Gfq based on the vehicle-speed-corresponding frequency fq detected by the vehicle-speed-corresponding frequency converting unit 51.

The third gain setting module 67 has functions to prepare a map that defines a relation between the accelerator position ap and a gain corresponding thereto (hereinafter referred to as an "accelerator position gain Gap"), and to set the accelerator position gain Gap based on the accelerator position ap detected by the accelerator position sensor 35.

The sound effect gain setting module 69A has functions to prepare a map that defines a relation between the engine state (the engine rotational frequency) es as well as the supplied electric power amount sp and a gain corresponding thereto (hereinafter referred to as a "sound effect gain Gef"), and to set the sound effect gain Gef based on the engine state es and the supplied electric power amount sp.

To be more precise, in the case where the residual capacity of the storage battery falls below a predetermined first residual capacity threshold and the driving of the electric motor is practically stopped, the sound effect gain setting module 69A sets the sound effect gain (which corresponds to an "amplitude adjustment gain" of the present invention) Gef substantially equal to zero. As for the first residual capacity threshold, a value of a residual capacity, at which the charge control of the storage battery is to be started, or the like may be set as appropriate, for example. Here, the case where the residual capacity of the storage battery falls below the predetermined first residual capacity threshold and the driving of the electric motor is practically stopped is assumed to be a case where the residual capacity of the storage battery declines to such a level that the storage battery needs to be charged and the driving of the electric motor is actually stopped.

Meanwhile, in the case where the residual capacity of the storage battery is equal to or above a predetermined second residual capacity threshold and the electric motor is driven, the sound effect gain setting module 69A sets the sound effect gain (the amplitude adjustment gain) Gef larger than that in the case where the residual capacity of the storage battery falls below the second residual capacity threshold. As for the second residual capacity threshold, a value of the residual capacity, at which the drive control of the electric motor is to be performed on a preferential basis, or the like may be set as appropriate, for example. Here, the case where the residual capacity of the storage battery is equal to or above the second residual capacity threshold and the electric motor is driven is assumed to be a case where the drive control of the electric motor is performed on the preferential basis and the electric motor is actually driven.

In the meantime, in the case where the supplied electric power amount sp to the electric motor falls below a predetermined first electric power amount threshold and the driving of the electric motor is practically stopped, the sound effect gain setting module 69A sets the sound effect gain (which corresponds to the "amplitude adjustment gain" of the present invention) Gef substantially equal to zero. As for the first electric power amount threshold, a value of the supplied electric power amount sp, in the case where the drive control of the engine 13 is performed on the preferential basis, or the like may be set as appropriate, for example. Here, the case where the supplied electric power amount sp to the electric motor falls below the predetermined first electric power amount threshold and the driving of the electric motor is practically stopped is assumed to be a case where the supplied electric power amount sp to the electric motor declines to such a level that the drive control of the engine 13 is to be performed on the preferential basis and the driving of the electric motor is actually stopped.

Meanwhile, in the case where the supplied electric power amount sp to the electric motor is equal to or above a predetermined second electric power amount threshold and the electric motor is driven, the sound effect gain setting module 69A sets the sound effect gain (the amplitude adjustment gain) Gef larger than that in the case where the supplied electric power amount sp to the electric motor falls below the second electric power amount threshold. As for the second electric power amount threshold, a value of the supplied electric power amount sp to the electric motor, in the case where the drive control of the electric motor is performed on the preferential basis, or the like may be set as appropriate, for example. Here, the case where the supplied electric power amount sp to the electric motor is equal to or above the second electric power amount threshold and the electric motor is driven is assumed to be the case where the drive control of the electric motor is performed on the preferential basis and the electric motor is actually driven.

The multiplier mp1 has a function to multiply the vehicle-speed-corresponding frequency gain Gfq set by the second gain setting module 65 by the accelerator position gain Gap set by the third gain setting module 67. A multiplication result by the multiplier mp1 is outputted to the adder ad3.

The adder ad3 has a function to add the amount-of-change-in-frequency gain GΔfqv set by the first gain setting module 63 to the multiplication result by the multiplier mp1. An addition result by the adder ad3 is outputted to the multiplier mp2.

The multiplier mp2 has a function to multiply the addition result by the adder ad3 by the sound effect gain Gef (the gain for correcting the sound pressure frequency characteristic related to the sound effect at the arbitrary time point) set by the sound effect gain setting module 69A. A multiplication result by the multiplier mp2 is outputted to the correction filter 71.

The correction filter 71 has a function to generate a corrected control signal by multiplying the control signal, which is formed as a consequence of addition by the adder ad2 of the control signal generating unit 57, by the multiplication result by the multiplier mp2. The control signal corrected by the correction filter 71 is outputted to the adder ad1.

(Operations of ASC Apparatus 11A According to First Embodiment)

Next, operations of the ASC apparatus 11A according to the first embodiment will be described with reference to FIG. 2.

In the ASC apparatus 11A according to the first embodiment, the vehicle-speed-corresponding frequency converting unit 51 converts the change in vehicle speed into the change in frequency, and outputs the vehicle-speed-corresponding frequency fq in the form of the digital signal.

The second-order multiplying module 53*a*, the third-order multiplying module 53*b*, and the fourth-order multiplying module 53*c* collectively constituting the multiplying unit 53 output the harmonic frequencies of the predetermined multiplying factors (namely, the second harmonic vehicle-speed-corresponding frequency fq1, the third harmonic vehicle-speed-corresponding frequency fq2, and the fourth harmonic vehicle-speed-corresponding frequency fq3), respectively, based on the vehicle-speed-corresponding frequency fq of the basic order converted by the vehicle-speed-corresponding frequency converting unit 51.

The reference signal generating unit 55 generates the harmonic reference signals (the sinusoidal signals) based respectively on the vehicle-speed-corresponding frequencies fq1, fq2, and fq3 that are sent out of the multiplying unit 53 from moment to moment, by referring to the waveform data stored in the waveform data table 56.

The flattening processing modules SI_1-1, SI_2-1, and SI_3-1 of the control signal generating unit 57 perform the flattening processing, respectively, to generate sound effects having linear feeling with respect to an accelerating operation by use of the harmonic reference signals related to the sound effects generated by the reference signal generating unit 55.

The frequency emphasis processing modules SI_1-2, SI_2-2, and SI_3-2 perform the frequency emphasis processing on the harmonic reference signals related to the sound effects after the flattering processing, respectively, to emphasize the sound components that belong to a certain frequency band.

Then, the order-based correction processing modules SI_1-3, SI_2-3, and SI_3-3 perform the processing on the harmonic reference signals related to the sound effects after the frequency emphasis processing, respectively, to correct the reference signals based on the orders.

Subsequently, the adder ad2 outputs the control signal obtained by adding the three signals (which have the sound pressure frequency characteristics related to the sound effects at the arbitrary time point) after the order-based correction processing.

The signal processing unit 61 performs sound pressure correction signal processing on the control signal related to the sound effects formed by addition by the adder ad2. As a consequence of the sound pressure correction signal processing by the signal processing unit 61, it is possible to arrange a driving environment that matches the maneuvering feeling of the driver by raising a sound pressure level of the sound effect in various situations appropriate for providing the sound effect, such as a situation where the amount of change in frequency Δfqv is large, a situation where the vehicle speed (the vehicle-speed-corresponding frequency fq) is relatively high, and a situation where the driver is pressing down the accelerator pedal a lot.

Meanwhile, in the sound pressure correction signal processing by the signal processing unit 61, the sound effect gain Gef is set substantially equal to zero when the supplied electric power amount sp to the electric motor falls below the first electric power amount threshold and the driving of the electric motor is practically stopped, for example. Thus, it is possible to appropriately arrange the sound effect that matches a condition of the vehicle or an intention of the passenger as a result of withdrawing the provision of the sound effect in a situation where the sound effect is unnecessary.

Moreover, in the sound pressure correction signal processing by the signal processing unit 61, the sound effect gain Gef is set larger than that in the case where the supplied electric power amount sp to the electric motor falls below the second electric power amount threshold when the supplied electric power amount sp to the electric motor is equal to or above the second electric power amount threshold and the electric motor is driven. Thus, it is possible to appropriately arrange the sound effect that matches the condition of the vehicle or the intention of the passenger as a result of raising the sound pressure level of the sound effect in a situation where it is appropriate to provide the sound effect.

Furthermore, by causing the control signal generating unit 57 to perform weighting as appropriate based on sound pressure frequency characteristics of a vehicle interior sound field and the driver seat speaker 25 and on the vehicle-speed-corresponding frequency fq, it is also possible to arrange the sound effect so as to sound more naturally even in the case of a change in amount of acceleration or a change in the vehicle-speed-corresponding frequency fq.

The adder ad1 adds the control signal (which has the sound pressure frequency characteristic related to the sound effect at the arbitrary time point) concerning the sound effect (in digital) after the sound pressure correction signal processing by the signal processing unit 61 to the sound effect (digital) signal from the ANC apparatus 17. The sound effect (digital) signal after the addition is sent to the D/A converter 27.

The D/A converter 27 converts the sound effect (digital) signal, which is formed by the addition of the signals from ASC apparatus 11 and the ANC apparatus 17 by the adder ad1, into the sound effect (analog) signal. The converted sound effect (analog) signal is sent to the audio amplifier 29.

The audio amplifier 29 amplifies the sound (analog) signal converted by the D/A converter 27 and containing the sound effect, and outputs the amplified signal to the driver seat speaker 25. In this way, the sound related to the sound effect (air intake sound) is outputted from the driver seat speaker 25.

(Internal Configuration of ASC Apparatus 11B According to Second Embodiment)

Figure 3:
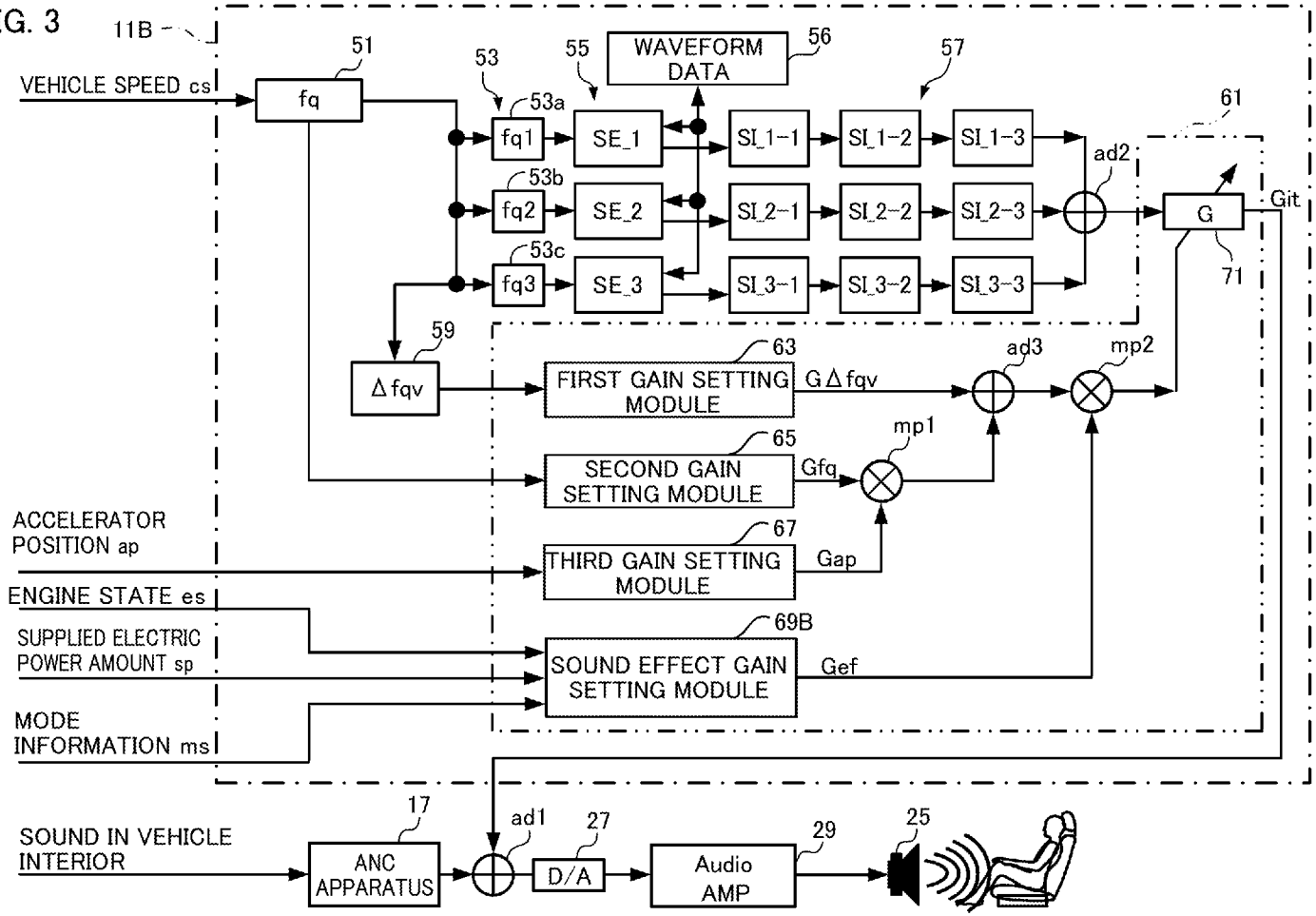
FIG. 3 is a block configuration diagram showing an internal configuration of an ASC apparatus according to a second embodiment.

Next, an internal configuration of an ASC apparatus 11B according to a second embodiment will be described with reference to FIG. 3. FIG. 3 is a block configuration diagram showing the internal configuration of the ASC apparatus 11B according to the second embodiment.

Regarding the ASC apparatus 11A according to the first embodiment and the ASC apparatus 11B according to the second embodiment, the configuration of a sound effect gain setting module 69B according to the second embodiment is different from the configuration of the sound effect gain setting module 69A according to the first embodiment, but the rest of the configurations are the same. Hence, a description of the ASC apparatus 11B according to the second embodiment with reference FIG. 3 will replace a description of the configuration of the sound effect gain setting module 69B according to the second embodiment.

As shown in FIG. 3, the sound effect gain setting module 69B according to the second embodiment has functions to prepare a map that defines a relation between the engine state (the engine rotational frequency)es, the supplied electric power amount sp, as well as mode information ms and the sound effect gain Gef corresponding thereto, and to set the sound effect gain Gef based on the engine state es, the supplied electric power amount sp, and the mode information ms. A different feature between the ASC apparatus 11A according to the first embodiment and the ASC apparatus 11B according to the second embodiment is that the mode information ms is added to input parameters used for setting the sound effect gain Gef in the second embodiment.

In the case where the sound effect gain setting module 69B according to the second embodiment acquires (charge) mode information ms indicating that the storage battery is set in a charge mode (to be charged on the preferential basis), the sound effect setting module 69B judges that an intention of the driver for acceleration is low and sets the sound effect gain Gef substantially equal to zero.

Moreover, in the case where the sound effect gain setting module 69B according to the second embodiment acquires (traveling) mode information ms indicating that the traveling mode of the vehicle 15 is set to the sport traveling mode (in which the engine rotational frequency is kept high), the sound effect setting module 69B may judge that the intention of the driver for acceleration is high and may set the sound effect gain Gef larger than that in the case where the traveling mode of the vehicle 15 is set to a normal traveling mode.

Furthermore, in the case where the sound effect gain setting module 69B according to the second embodiment acquires (drive force transmission) mode information ms indicating that the drive force transmission mode of the vehicle 15 is set to the engine direct coupling mode (in which the drive force is increased on the preferential basis), the sound effect setting module 69B may judge that the intention of the driver for acceleration is high and may set the sound effect gain Gef larger than that in the case where the drive force transmission mode is not set to the engine direct coupling mode.

Note that in the case where a combination of any of the aforementioned three pieces of the mode information ms is acquired, the sound effect gain setting module 69B according to the second embodiment may appropriately set the sound effect gain Gef in a size corresponding to the combination of any of the multiple pieces of the mode information ms in consideration of weighting depending on the pieces of the mode information ms (while presetting an appropriate value for each piece of the mode information ms).

(Operations of ASC Apparatus 11B According to Second Embodiment)

Next, operations of the ASC apparatus 11B according to the second embodiment will be described with reference to FIG. 3, while focusing on different features from the operations of the ASC apparatus 11A according to the first embodiment.

In the ASC apparatus 11B according to the second embodiment, in the case where the (charge) mode information ms indicating that the storage battery is set in the charge mode (to be charged on the preferential basis) is acquired in the sound pressure correction signal processing by the signal processing unit 61, for example, the signal processing unit 61 judges that the intention of the driver for acceleration is low and sets the sound effect gain Gef substantially equal to zero. Thus, it is possible to appropriately arrange the sound effect that matches the condition of the vehicle or the intention of the passenger as a result of withdrawing the provision of the sound effect in a situation where the sound effect is unnecessary.

Moreover, in the case where the (traveling) mode information ms indicating that the traveling mode of the vehicle 15 is set to the sport traveling mode (in which the engine rotational frequency is kept high) is acquired in the sound pressure correction signal processing by the signal processing unit 61, for example, the signal processing unit 61 judges that the intention of the driver for acceleration is high and sets the sound effect gain Gef larger than that in the case where the traveling mode of the vehicle 15 is set to the normal traveling mode. Thus, it is possible to appropriately arrange the sound effect that matches the condition of the vehicle or the intention of the passenger as a result of raising the sound pressure level of the sound effect in a situation where it is appropriate to provide the sound effect.

Furthermore, in the case where the (drive force transmission) mode information ms indicating that the drive force transmission mode of the vehicle 15 is set to the engine direct coupling mode (in which the drive force is increased on the preferential basis) is acquired in the sound pressure correction signal processing by the signal processing unit 61, for example, the signal processing unit 61 judges that the intention of the driver for acceleration is high and sets the sound effect gain Gef larger than that in the case where the drive force transmission mode is not set to the engine direct coupling mode. Thus, it is possible to appropriately arrange the sound effect that matches the condition of the vehicle or the intention of the passenger as a result of raising the sound pressure level of the sound effect in a situation where it is appropriate to provide the sound effect.

(Internal Configuration of ASC Apparatus 11C According to Third Embodiment)

Figure 4:
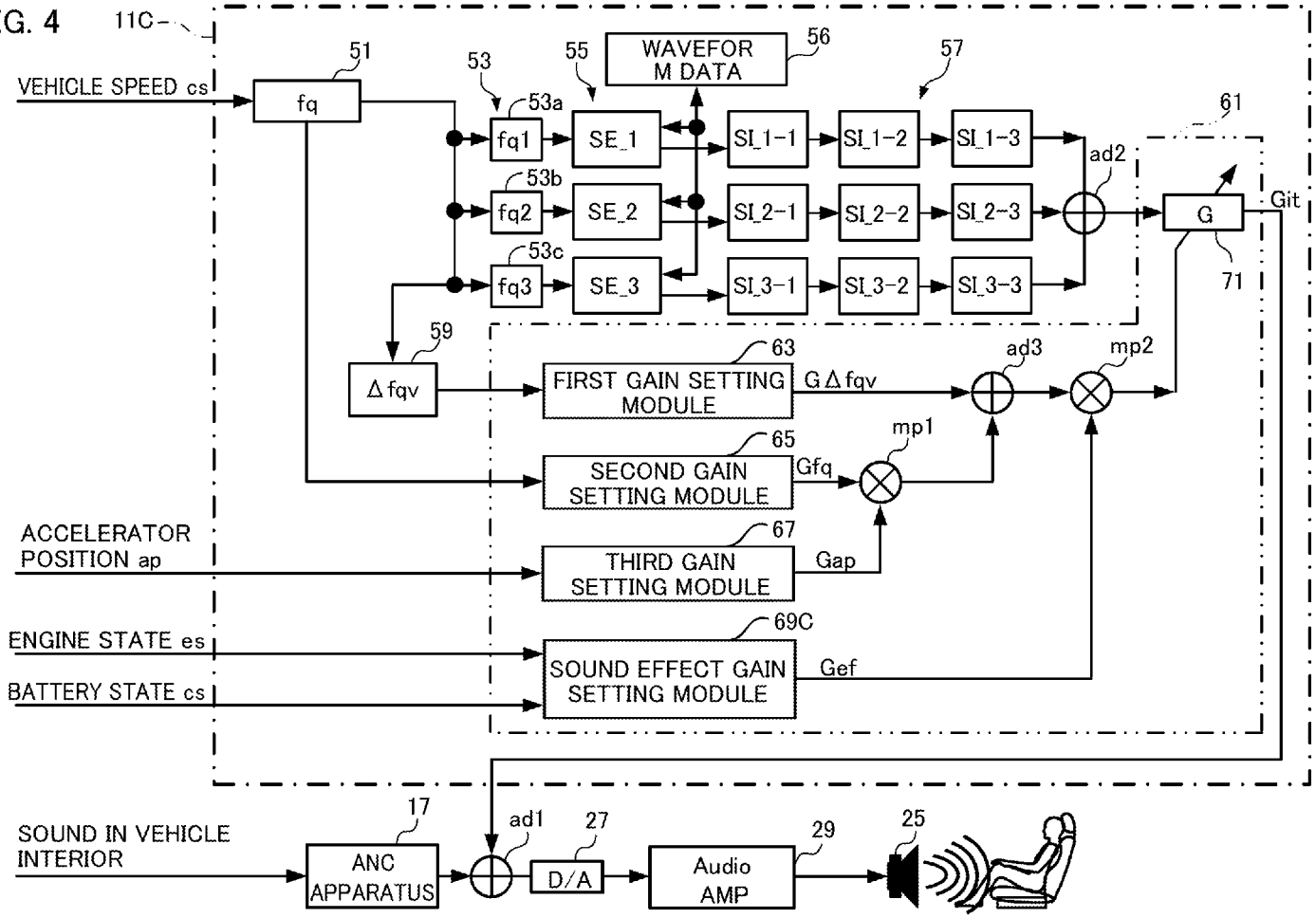
FIG. 4 is a block configuration diagram showing an internal configuration of an ASC apparatus according to a third embodiment.

Next, an internal configuration of an ASC apparatus 11C according to a third embodiment will be described with reference to FIG. 4. FIG. 4 is a block configuration diagram showing the internal configuration of the ASC apparatus 11C according to the third embodiment.

Regarding the ASC apparatus 11A according to the first embodiment and the ASC apparatus 11C according to the third embodiment, the configuration of a sound effect gain setting module 69C according to the third embodiment is different from the configuration of the sound effect gain setting module 69A according to the first embodiment, but the rest of the configurations are the same. Hence, a description of the ASC apparatus 11C according to the third embodiment with reference to FIG. 4 will replace a description of the configuration of the sound effect gain setting module 69C according to the third embodiment.

As shown in FIG. 4, the sound effect gain setting module 69C according to the third embodiment has functions to prepare a map that defines a relation between the engine state (the engine rotational frequency) es as well as the battery state cs and the sound effect gain Gef corresponding thereto, and to set the sound effect gain Gef based on the engine state es and the battery state cs. A different feature between the ASC apparatus 11A according to the first embodiment and the ASC apparatus 11C according to the third embodiment is that the supplied electric power amount sp is deleted from and the battery state cs is instead added to the parameters used for setting the sound effect gain Gef in the third embodiment.

In the case where the residual capacity of the storage battery falls below the first residual capacity threshold and the driving of the electric motor is practically stopped, for example, the sound effect gain setting module 69C according to the third embodiment sets the sound effect gain Gef substantially equal to zero. Thus, it is possible to appropriately arrange the sound effect that matches the condition of the vehicle or the intention of the passenger as a result of withdrawing the provision of the sound effect in a situation where the sound effect is unnecessary.

Moreover, in the case where the residual capacity of the storage battery is equal to or above the second residual capacity threshold and the electric motor is driven, the sound effect gain setting module 69C according to the third embodiment sets the sound effect gain Gef larger than that in the case where the residual capacity of the storage battery falls below the second residual capacity threshold. Thus, it is possible to appropriately arrange the sound effect that matches the condition of the vehicle or the intention of the passenger as a result of raising the sound pressure level of the sound effect in a situation where it is appropriate to provide the sound effect.

(Operations and Effects of ASC Apparatus 11 According to Present Invention)

Next, the operations and effects of the ASC apparatus 11 according to the present invention will be described.

The ASC apparatus 11 based on a first perspective provides the active sound control apparatus 11 which actively generates a sound effect inside the cabin of the vehicle 15 provided with the internal combustion engine 13 and the electric motor as the driving sources.

The ASC apparatus 11 based on the first perspective includes: the waveform data table 56 which stores the waveform data used to generate the sound effect; the vehicle-speed-corresponding frequency converting unit 51 which converts the vehicle speed cs into the vehicle-speed-corresponding frequency fq that is the frequency based on the vehicle speed cs; the reference signal generating unit 55 which generates a harmonic reference signal based on the vehicle-speed-corresponding frequency fq by referring to the waveform data; the driver seat speaker (the sound output unit) 25 which outputs the sound including the sound effect; the signal processing unit 61 which generates the control signal that forms the sound effect by multiplying the reference signal by the sound effect gain (the amplitude adjustment gain) Gef related to the reference signal, and outputs the control signal to the driver seat speaker 25; and the battery state sensor (a state-of-charge acquisition unit) 43 which acquires the state of charge inclusive of the residual capacity of the storage battery that supplies the electric power to the electric motor. The signal processing unit 61 sets the sound effect gain (the amplitude adjustment gain) Gef based on the state of charge of the storage battery.

In the ASC apparatus 11 based on the first perspective, the reference signal generating unit 55 generates the harmonic reference signal based on the vehicle-speed-corresponding frequency fq by referring to the waveform data. The signal processing unit 61 generates the control signal that forms the sound effect by multiplying the reference signal by the sound effect gain (the amplitude adjustment gain) Gef related to the reference signal, and outputs the control signal to the driver seat speaker 25. Here, the signal processing unit 61 is configured to set the sound effect gain Gef based on the state of charge of the storage battery.

According to the ASC apparatus 11 based on the first perspective, the signal processing unit 61 sets the sound effect gain Gef related to the reference signal based on the state of charge of the storage battery. Thus, the ASC apparatus 11 can arrange the sound effect in the vehicle 15 provided with the internal combustion engine 13 and the electric motor as the driving sources, which matches the condition of the vehicle or the intention of the passenger.

Meanwhile, the ASC apparatus 11 based on a second perspective provides the ASC apparatus 11 based on the first perspective in which, in the case where the residual capacity of the storage battery falls below the predetermined first residual capacity threshold, the signal processing unit 61 sets the sound effect gain Gef smaller than that in the case where the residual capacity of the storage battery is equal to or above the first residual capacity threshold.

According to the ASC apparatus 11 based on the second perspective, in the case where the residual capacity of the storage battery falls below the first residual capacity threshold, the signal processing unit 61 sets the sound effect gain Gef smaller than that in the case where the residual capacity of the storage battery is equal to or above the first residual capacity threshold. Thus, the ASC apparatus 11 can appropriately arrange the sound effect that matches the condition of the vehicle or the intention of the passenger.

Meanwhile, the ASC apparatus 11 based on a third perspective provides the ASC apparatus 11 based on the first perspective in which, in the case where the residual capacity of the storage battery falls below the predetermined first residual capacity threshold, the signal processing unit 61 sets the sound effect gain Gef substantially equal to zero. Here, setting the sound effect gain Gef substantially equal to zero means practically withdrawing the provision of the sound effect by setting the amplitude of a signal component related to the sound effect equal to zero.

According to the ASC apparatus 11 based on the third perspective, in the case where the residual capacity of the storage battery falls below the first residual capacity threshold, the signal processing unit 61 sets the sound effect gain Gef substantially equal to zero. Thus, the ASC apparatus 11 can appropriately arrange the sound effect that matches the condition of the vehicle or the intention of the passenger as a result of withdrawing the provision of the sound effect in a situation where the sound effect is unnecessary.

Meanwhile, the ASC apparatus 11 based on a fourth perspective provides the ASC apparatus 11 based on the first perspective in which, in the case where the residual capacity of the storage battery is equal to or above the predetermined second residual capacity threshold, the signal processing unit 61 sets the sound effect gain Gef larger than that in the case where the residual capacity of the storage battery falls below the second residual capacity threshold.

According to the ASC apparatus 11 based on the fourth perspective, in the case where the residual capacity of the storage battery is equal to or above the second residual capacity threshold, the signal processing unit 61 sets the sound effect gain Gef larger than that in the case where the residual capacity of the storage battery falls below the second residual capacity threshold. Thus, the ASC apparatus 11 can appropriately arrange the sound effect that matches the condition of the vehicle or the intention of the passenger as a result of raising the sound pressure level of the sound effect in the case where the drive control of the electric motor is performed on the preferential basis (where it is appropriate to provide the sound effect).

Meanwhile, the ASC apparatus 11 based on a fifth perspective provides the ASC apparatus 11 based on the second perspective in which, in the case where the driving of the electric motor is practically stopped, the signal processing unit 61 sets the sound effect gain Gef smaller than that in the case where the residual capacity of the storage battery is equal to or above the first residual capacity threshold. Here, the case where the driving of the electric motor is practically stopped means a state where the driving of the vehicle and the charging of the storage battery are covered by the drive force of the internal combustion engine.

According to the ASC apparatus 11 based on the fifth perspective, in the case where the driving of the electric motor is practically stopped, the signal processing unit 61 sets the sound effect gain Gef smaller than that in the case where the residual capacity of the storage battery is equal to or above the first residual capacity threshold. Thus, the ASC apparatus 11 can appropriately arrange the sound effect that matches the condition of the vehicle or the intention of the passenger as with the ASC apparatus 11 based on the second perspective.

Meanwhile, the ASC apparatus 11 based on a sixth perspective provides the ASC apparatus 11 based on the third perspective in which, in the case where the driving of the electric motor is practically stopped, the signal processing unit 61 sets the sound effect gain Gef substantially equal to zero.

According to the ASC apparatus 11 based on the sixth perspective, in the case where the driving of the electric motor is practically stopped, the signal processing unit 61 sets the sound effect gain Gef substantially equal to zero. Thus, the ASC apparatus 11 can appropriately arrange the sound effect that matches the condition of the vehicle or the intention of the passenger as a result of withdrawing the provision of the sound effect in a situation where the sound effect is unnecessary as with the ASC apparatus 11 based on the third perspective.

Meanwhile, the ASC apparatus 11 based on a seventh perspective provides the ASC apparatus 11 based on the fourth perspective in which, in the case where the electric motor is driven, the signal processing unit 61 sets the sound effect gain Gef larger than that in the case where the residual capacity of the storage battery falls below the second residual capacity threshold.

According to the ASC apparatus 11 based on the seventh perspective, in the case where the electric motor is driven, the signal processing unit 61 sets the sound effect gain Gef larger than that in the case where the residual capacity of the storage battery falls below the second residual capacity threshold. Thus, the ASC apparatus 11 can appropriately arrange the sound effect that matches the condition of the vehicle or the intention of the passenger as a result of raising the sound pressure level of the sound effect in the situation where the drive control of the electric motor is performed on the preferential basis (where it is appropriate to provide the sound effect) as with the ASC apparatus 11 based on the fourth perspective.

In the meantime, the ASC apparatus 11 based on an eighth perspective provides the active sound control apparatus 11 which actively generates a sound effect inside the cabin of the vehicle 15 provided with the internal combustion engine 13 and the electric motor as the driving sources.

The ASC apparatus 11 based on the eighth perspective includes: the waveform data table 56 which stores the waveform data used to generate the sound effect; the vehicle-speed-corresponding frequency converting unit 51 which converts the vehicle speed cs into the vehicle-speed-corresponding frequency fq that is the frequency based on the vehicle speed cs; the reference signal generating unit 55 which generates a harmonic reference signal based on the vehicle-speed-corresponding frequency fq by referring to the waveform data; the driver seat speaker (the sound output unit) 25 which outputs the sound including the sound effect; the signal processing unit 61 which generates the control signal that forms the sound effect by multiplying the reference signal by the sound effect gain (the amplitude adjustment gain) Gef related to the reference signal, and outputs the control signal to the driver seat speaker 25; and the amount-of-electric-power sensor (the supplied electric power acquisition unit) 39 which acquires the electric power supplied from the storage battery to the electric motor, in which the most important feature of the signal processing unit 61 is to set the sound effect gain Gef based on the supplied electric power amount sp to the electric motor.

In the ASC apparatus 11 based on the eighth perspective, the reference signal generating unit 55 generates the harmonic reference signal based on the vehicle-speed-corresponding frequency fq by referring to the waveform data. The signal processing unit 61 generates the control signal that forms the sound effect by multiplying the reference signal by the sound effect gain (the amplitude adjustment gain) Gef related to the reference signal, and outputs the control signal to the driver seat speaker 25. Here, the signal processing unit 61 is configured to set the sound effect gain Gef based on the supplied electric power amount sp to the electric motor.

Note that the supplied electric power amount sp to the electric motor is equivalent to an amount of electric power outputted from the storage battery. Alternatively, instead of the supplied electric power amount sp to the electric motor, the signal processing unit 61 may be configured to set the sound effect gain Gef based on the residual capacity of the storage battery and temperature information.

According to the ASC apparatus 11 based on the eighth perspective, the signal processing unit 61 sets the sound effect gain Gef based on the electric power supplied to the electric motor. Thus, the ASC apparatus 11 can arrange the sound effect in the vehicle provided with the internal combustion engine 13 and the electric motor as the driving sources, which matches the condition of the vehicle or the intention of the passenger.

Meanwhile, the ASC apparatus 11 based on a ninth perspective provides the ASC apparatus 11 based on the eighth perspective in which, in the case where the supplied electric power amount sp to the electric motor falls below the predetermined first electric power amount threshold, the signal processing unit 61 sets the sound effect gain Gef smaller than that in the case where the supplied electric power amount sp is equal to or above the first electric power amount threshold.

According to the ASC apparatus 11 based on the ninth perspective, in the case where the supplied electric power amount sp to the electric motor falls below the first electric power amount threshold, the signal processing unit 61 sets the sound effect gain Gef smaller than that in the case where the supplied electric power amount sp to the electric motor is equal to or above the first electric power amount threshold. Thus, the ASC apparatus 11 can appropriately arrange the sound effect that matches the condition of the vehicle or the intention of the passenger.

Meanwhile, the ASC apparatus 11 based on a tenth perspective provides the ASC apparatus 11 based on the eighth perspective in which, in the case where the supplied electric power amount sp to the electric motor falls below the predetermined first electric power amount threshold, the signal processing unit 61 sets the sound effect gain Gef substantially equal to zero. Here, setting the sound effect gain Gef substantially equal to zero means practically withdrawing the provision of the sound effect by setting the amplitude of the signal component related to the sound effect equal to zero.

According to the ASC apparatus 11 based on the tenth perspective, in the case where the supplied electric power amount sp to the electric motor falls below the first electric power amount threshold, the signal processing unit 61 sets the sound effect gain Gef substantially equal to zero. Thus, the ASC apparatus 11 can appropriately arrange the sound effect that matches the condition of the vehicle or the intention of the passenger as a result of withdrawing the provision of the sound effect in a situation where the sound effect is unnecessary.

Meanwhile, the ASC apparatus 11 based on an eleventh perspective provides the ASC apparatus 11 based on the eighth perspective in which, in the case where the supplied electric power amount sp to the electric motor is equal to or above the predetermined second electric power amount threshold, the signal processing unit 61 sets the sound effect gain Gef larger than that in the case where the supplied electric power amount sp falls below the second electric power amount threshold.

According to the ASC apparatus 11 based on the eleventh perspective, in the case where the supplied electric power amount sp to the electric motor is equal to or above the second electric power amount threshold, the signal processing unit 61 sets the sound effect gain Gef larger than that in the case where the supplied electric power amount sp to the electric motor falls below the second electric power amount threshold. Thus, the ASC apparatus 11 can appropriately arrange the sound effect that matches the condition of the vehicle or the intention of the passenger as a result of raising the sound pressure level of the sound effect in the case where the drive control of the electric motor is performed on the preferential basis.

Meanwhile, the ASC apparatus 11 based on a twelfth perspective provides the ASC apparatus 11 based on the ninth perspective in which, in the case where the driving of the electric motor is practically stopped, the signal processing unit 61 sets the sound effect gain Gef smaller than that in the case where the supplied electric amount sp is equal to or above the first electric power amount threshold.

According to the ASC apparatus 11 based on the twelfth perspective, in the case where the driving of the electric motor is practically stopped, the signal processing unit 61 sets the sound effect gain Gef smaller than that in the case where the supplied electric amount sp is equal to or above the first electric power amount threshold. Thus, the ASC apparatus 11 can appropriately arrange the sound effect that matches the condition of the vehicle or the intention of the passenger as with the ASC apparatus 11 based on the ninth perspective.

Meanwhile, the ASC apparatus 11 based on a thirteenth perspective provides the ASC apparatus 11 based on the tenth perspective in which, in the case where the driving of the electric motor is practically stopped, the signal processing unit 61 sets the sound effect gain Gef substantially equal to zero.

According to the ASC apparatus 11 based on the thirteenth perspective, in the case where the driving of the electric motor is practically stopped, the signal processing unit 61 sets the sound effect gain Gef substantially equal to zero. Thus, the ASC apparatus 11 can appropriately arrange the sound effect that matches the condition of the vehicle or the intention of the passenger as a result of withdrawing the provision of the sound effect in a situation where the sound effect is unnecessary as with the ASC apparatus 11 based on the tenth perspective.

Meanwhile, the ASC apparatus 11 based on a fourteenth perspective provides the ASC apparatus 11 based on the eleventh perspective in which, in the case where the electric motor is driven, the signal processing unit 61 sets the sound effect gain Gef larger than that in the case where the supplied electric amount sp falls below the second electric power amount threshold.

According to the ASC apparatus 11 based on the fourteenth perspective, in the case where the electric motor is driven, the signal processing unit 61 sets the sound effect gain Gef larger than that in the case where the supplied electric amount sp falls below the second electric power amount threshold. Thus, the ASC apparatus 11 can appropriately arrange the sound effect that matches the condition of the vehicle or the intention of the passenger as a result of raising the sound pressure level of the sound effect in the case where the drive control of the electric motor is performed on the preferential basis as with the ASC apparatus 11 based on the eleventh perspective.

Other Embodiments

The above-described embodiments represent examples to embody the present invention. Accordingly, the interpretation of the technical scope of the present invention shall not be limited to these embodiments since the present invention can be embodied in various other modes without departing from the gist and the main characteristics thereof.

For example, the embodiments of the present invention have described the example in which the reference signal generating unit 55 includes the three reference signal generating modules (the first reference signal generating module SE_1, the second reference signal generating module SE_2, and the third reference signal generating module SE_3) having the same function. However, the present invention is not limited to this example. The number of the reference signal generating modules constituting the reference signal generating unit 55 may apply an appropriate number in accordance with a distribution condition of frequency bands of oscillation noises to be focused on by the active sound control apparatus 11, and other factors. In this case, the number of the multiplying modules 53 which multiply and output the frequencies of appropriate orders based on the vehicle-speed-corresponding frequency fq of the basic order, and the like may be changed in accordance with the quantity of the reference signal generating modules.

Meanwhile, the embodiments of the present invention have described the example in which the control signal generating unit 57 to perform the prescribed processing on the reference signals related to the sound effects generated by the reference signal generating unit 57 is provided between the reference signal generating unit 55 and the adder ad2. However, the present invention is not limited to this example. The control signal generating unit 57 may be omitted. In such a case, the adder ad2 maybe directed connected to the downstream of the reference signal generating unit 55.

Lastly, the embodiments of the present invention have described the example in which the driver seat speaker 25 is provided as the "sound output unit". However, the present invention is not limited to this example. An appropriate oscillator maybe employed as the "sound output unit" instead of or in addition to the speaker to vibrate the air in the vehicle interior.

What is claimed is:

1. An active sound control apparatus which actively generates a sound effect inside a cabin of a vehicle provided with an internal combustion engine and an electric motor as driving sources, comprising:

a waveform data table which stores waveform data used to generate the sound effect;

a vehicle-speed-corresponding frequency converting unit which converts a vehicle speed of the vehicle into a vehicle-speed-corresponding frequency that is a frequency based on the vehicle speed;

a reference signal generating unit which generates a harmonic reference signal based on the vehicle-speed-corresponding frequency by referring to the waveform data;

a sound output unit which outputs a sound including the sound effect;

a signal processing unit which generates a control signal that forms the sound effect by multiplying the reference signal by an amplitude adjustment gain related to the reference signal, and outputs the control signal to the sound output unit; and a state-of-charge acquisition unit which acquires a state of charge inclusive of a residual capacity of a storage battery that supplies electric power to the electric motor, wherein the signal processing unit sets the amplitude adjustment gain based on the state of charge of the storage battery.

2. The active signal control apparatus according to claim 1, wherein in a case where the residual capacity of the storage battery falls below a predetermined first residual capacity threshold, the signal processing unit sets the amplitude adjustment gain smaller than the amplitude adjustment gain in a case where the residual capacity of the storage battery is equal to or above the first residual capacity threshold.

3. The active signal control apparatus according to claim 1, wherein in a case where the residual capacity of the storage battery falls below a predetermined first residual capacity threshold, the signal processing unit sets the amplitude adjustment gain substantially equal to zero.

4. The active signal control apparatus according to claim 1, wherein in a case where the residual capacity of the storage battery is equal to or above a predetermined second residual capacity threshold, the signal processing unit sets the amplitude adjustment gain larger than the amplitude adjustment gain in a case where the residual capacity of the storage battery falls below the second residual capacity threshold.

5. The active signal control apparatus according to claim 2, wherein in a case where driving of the electric motor is practically stopped, the signal processing unit sets the amplitude adjustment gain smaller than the amplitude adjustment gain in the case where the residual capacity of the storage battery is equal to or above the first residual capacity threshold.

6. The active signal control apparatus according to claim 3, wherein in a case where driving of the electric motor is practically stopped, the signal processing unit sets the amplitude adjustment gain substantially equal to zero.

7. The active signal control apparatus according to claim 4, wherein in a case where the electric motor is driven, the signal processing unit sets the amplitude adjustment gain larger than the amplitude adjustment gain in the case where the residual capacity of the storage battery falls below the second residual capacity threshold.

8. An active sound control apparatus which actively generates a sound effect inside a cabin of a vehicle provided with an internal combustion engine and an electric motor as driving sources, comprising:

a waveform data table which stores waveform data used to generate the sound effect;

a vehicle-speed-corresponding frequency converting unit which converts a vehicle speed of the vehicle into a vehicle-speed-corresponding frequency that is a frequency based on the vehicle speed;

a reference signal generating unit which generates a harmonic reference signal based on the vehicle-speed-corresponding frequency by referring to the waveform data;

a sound output unit which outputs a sound including the sound effect;

a signal processing unit which generates a control signal that forms the sound effect by multiplying the reference signal by an amplitude adjustment gain related to the reference signal, and outputs the control signal to the sound output unit; and a supplied electric power acquisition unit which acquires electric power supplied from a storage battery to the electric motor, wherein the signal processing unit sets the amplitude adjustment gain based on the electric power supplied to the electric motor.

9. The active signal control apparatus according to claim 8, wherein in a case where a supplied electric power amount to the electric motor falls below a predetermined first electric power amount threshold, the signal processing unit sets the amplitude adjustment gain smaller than the amplitude adjustment gain in a case where the supplied electric power amount is equal to or above the first electric power amount threshold.

10. The active signal control apparatus according to claim 8, wherein in a case where a supplied electric power amount to the electric motor falls below a predetermined first electric power amount threshold, the signal processing unit sets the amplitude adjustment gain substantially equal to zero.

11. The active signal control apparatus according to claim 8, wherein in a case where a supplied electric power amount to the electric motor is equal to or above a predetermined second electric power amount threshold, the signal processing unit sets the amplitude adjustment gain larger than the amplitude adjustment gain in a case where the supplied electric power amount falls below the second electric power amount threshold.

12. The active signal control apparatus according to claim 9, wherein in a case where driving of the electric motor is practically stopped, the signal processing unit sets the amplitude adjustment gain smaller than the amplitude adjustment gain in the case where the supplied electric amount is equal to or above the first electric power amount threshold.

13. The active signal control apparatus according to claim 10, wherein in a case where driving of the electric motor is practically stopped, the signal processing unit sets the amplitude adjustment gain substantially equal to zero.

14. The active signal control apparatus according to claim 11, wherein in a case where the electric motor is driven, the signal processing unit sets the amplitude adjustment gain larger than the amplitude adjustment gain in the case where the supplied electric amount falls below the second electric power amount threshold.

* * * * *